United States Patent [19]

Griffith

[11] 4,150,698

[45] Apr. 24, 1979

[54] PATTERNING MEANS

[75] Inventor: John D. Griffith, Sunderland, England

[73] Assignee: Bonas Machine Company Limited, Staffordshire, England

[21] Appl. No.: 842,913

[22] Filed: Oct. 17, 1977

[30] Foreign Application Priority Data

Oct. 16, 1976 [GB] United Kingdom ..... 43068/76

[51] Int. Cl.[2] ..... D03C 3/14; D03C 3/32

[52] U.S. Cl. ..... 139/55.1; 139/59; 139/68; 139/89; 139/329; 139/333

[58] Field of Search ..... 139/55.1, 57, 66 R, 139/67, 68, 76, 80, 329, 331, 332, 333, 59, 72, 78, 89

[56] References Cited

U.S. PATENT DOCUMENTS

| | | | |
|---|---|---|---|
| 3,101,749 | 8/1963 | Pfarrwaller | 139/329 |
| 3,771,571 | 11/1973 | Xaus | 139/331 |
| 3,848,643 | 11/1974 | Wicker | 139/68 |
| 3,949,788 | 4/1976 | Speich | 139/57 |

FOREIGN PATENT DOCUMENTS

| | | | |
|---|---|---|---|
| 418580 | 8/1974 | U.S.S.R. | 139/68 |

*Primary Examiner*—Henry Jaudon
*Attorney, Agent, or Firm*—James E. Nilles

[57] ABSTRACT

A loom patterning mechanism including a continuously movable pattern information means and pattern sensing means associated with the information means and movable synchronously therewith over at least part of a loom cycle, the sensing means serving to initiate a loom function.

21 Claims, 6 Drawing Figures

38
37

34
35
36
35
31
16
17
29
15
-13-

PATTERNING MEANS

BACKGROUND OF THE INVENTION

1. Field of Use

This invention concerns patterning means for looms and in particular though not exclusively narrow fabric (or small ware) looms.

2. Description of the Prior Art

Many alternative patterning means are known, one of which is a jacquard mechanism, and have been used or proposed for use with both broadloom and narrow fabric looms.

It has generally been acknowledged by those persons skilled in the art that known jacquard mechanisms have characteristics that preclude their use with the present day high-speed needle looms commonly used in the production of narrow fabrics. One of the disadvantages of known jacquard mechanisms is the high total inertia of all the parts of the mechanism which have to be moved in accordance with the pattern contained on the pattern cards. In addition the pattern cards move stepwise, or intermittently, to present each card to a pattern controlling station sequentially. Both of these characteristics of the mechanism are, as is well known and understood, detrimental to high-speed operation.

SUMMARY OF THE INVENTION

It is recognized that some features of the jacquard mechanism could advantageously be used for the control of a narrow fabric loom and the present invention is based upon the appreciation of the possibility of producing a jacquard mechanism in which the disadvantages outlined above are substantially overcome or mitigated thus to enable the mechanism to be operated both in a broadloom and in present day high-speed needle looms.

A further object of the present invention is to produce a jacquard mechanism which is compact and consequently capable of being located at a position below the loom healds, that it is to control for the purpose of patterning.

Thus according to the present invention there is provided a loom patterning mechanism including continuously movable pattern information means and associated pivotably mounted pattern information sensing means arranged to be movable synchronously with the information means for at least part of a loom cycle, there being control means associated with the sensing means adapted to control a warp yarn carrier or carriers in accordance with the pattern information and in timed relationship with the loom weaving cycle.

DESCRIPTION OF A PREFERRED EMBODIMENT

Figure 1:
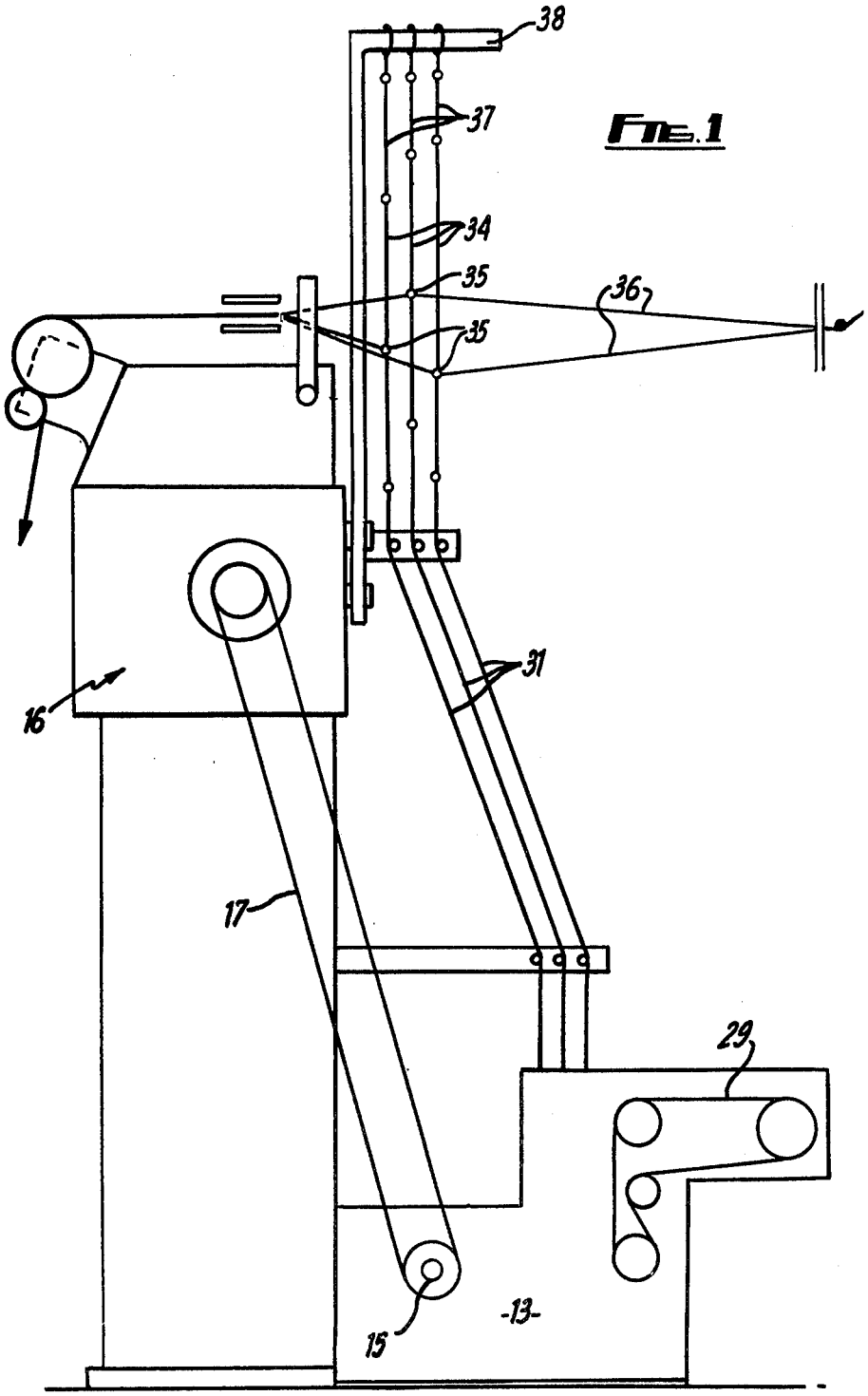
FIG. 1 is a schematic side elevation of a loom equipped with a patterning means made in accordance with the invention.

As can be seen from the drawings, a patterning mechanism made in accordance with the invention includes a pair of operating levers 10, 11 pivotally mounted at one end on a pivot pin 12 which is mounted on a convenient part of a loom frame 13. Cam means 14 are provided on a main shaft 15 of the mechanism, this shaft being driven in timed relationship with the loom 16 by means of a driving belt 17. Pins 18, 19 are provided on the extremities of levers 10, 11 opposite to the pivot pin 12 such that the levers 10, 11 respectively are moved alternately in each successive weaving cycle. Lifting hooks 20, 21 respectively are slidably mounted on pins 18, 19. The hooks 20, 21 are connected together by a cord 22 which passes over a lower pulley 23 carried in pulley block 24.

Lifting hooks 20, 21 are further provided respectively with an engaging eye 25, 26 positioned so as to be locatable in a position respectively to receive an engaging pin 27, 28 movable as will be determined by a pattern strip 29 in which pattern perforations 39 have been formed to correspond with a desired weaving pattern in a manner known in the art.

Pulley block 24 carries an upper pulley 30 around which passes a harness cord 31, one end 32 of which is anchored to frame 13 of the loom and the other end 33 to the lower extremity of a heald 34 provided with heald eye 35 which carries a warp end 36. The upper extremity of heald 34 is connected by an elastic means 37 to loom frame 38. While reference is made above to the connection of the harness cord 31 to a heald 34 it should be borne in mind that to carry out a different pattern control function the end 33 of harness cord 31 could be connected to loom 16 elsewhere to control, for example, the selection of multiple wefts, or intermittent operation of fabric take-down.

Pattern strip 29 is provided with driving perforations 40 to enable it to be driven at constant linear speed by engagement in the perforations 40 of the teeth of a toothed wheel 41 driven from mainshaft 15 in suitable speed relationship determined by the linear interval between successive pattern perforations 39 on the pattern strip 29 and the need to advance the pattern perforations 39 by one pitch (or interval) at each successive weaving cycle.

At its effective operating point the pattern strip 29 passes over an anvil 42 mounted on a lever 43 which in turn is mounted on a shaft 44 journalled in loom frame 13. Also mounted on shaft 44 is an operating lever 45 which co-operates with a cam means 46 carried on main shaft 15. The arrangement is such that shaft 44 is given a small rocking motion at each weaving cycle to cause anvil 42, and hence pattern strip 29, to carry out a small fore-and-aft movement of, for example, 2 millemeters.

Figure 2:
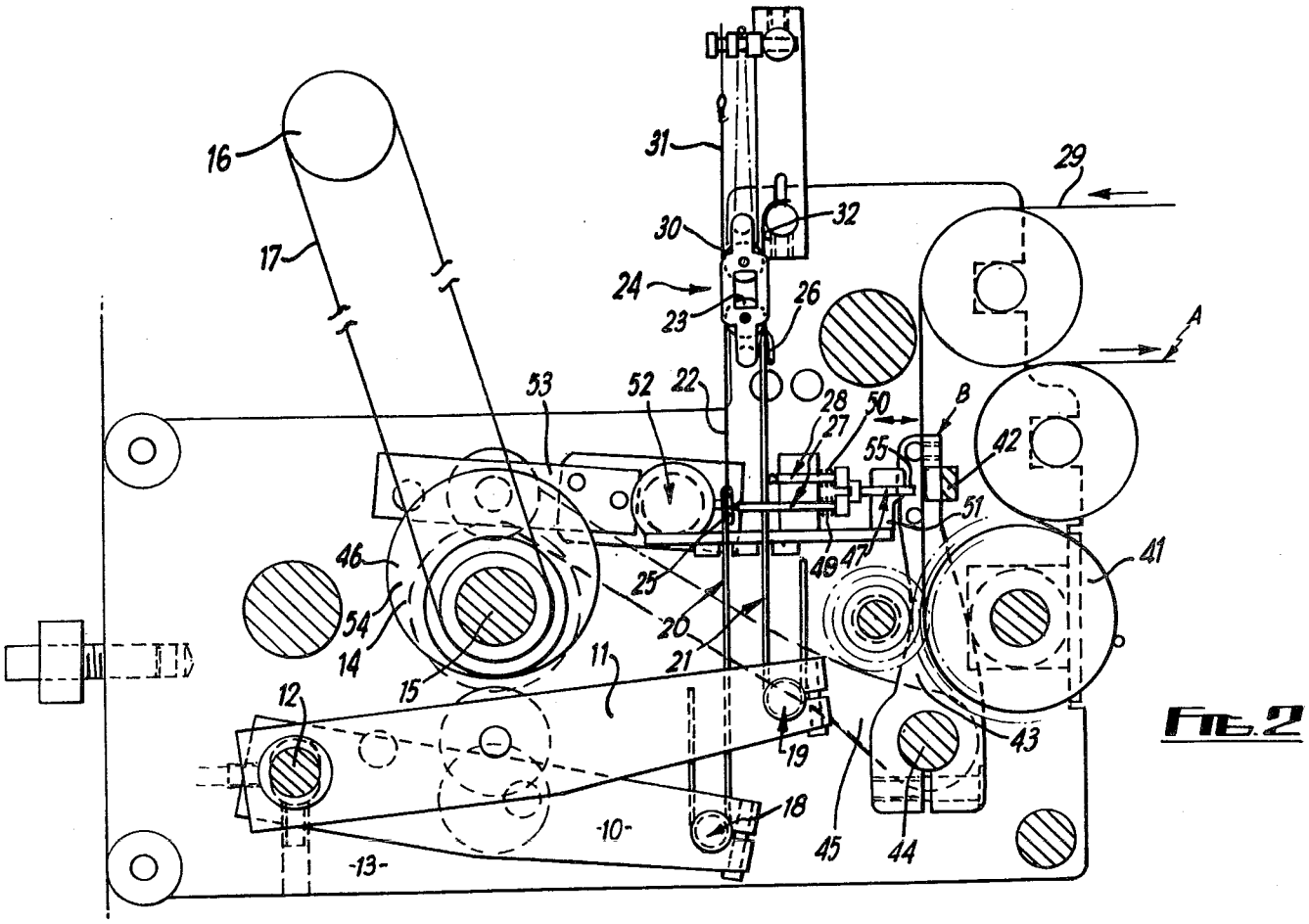
FIG. 2 is a part sectional elevation of the patterning means.
Figure 3:
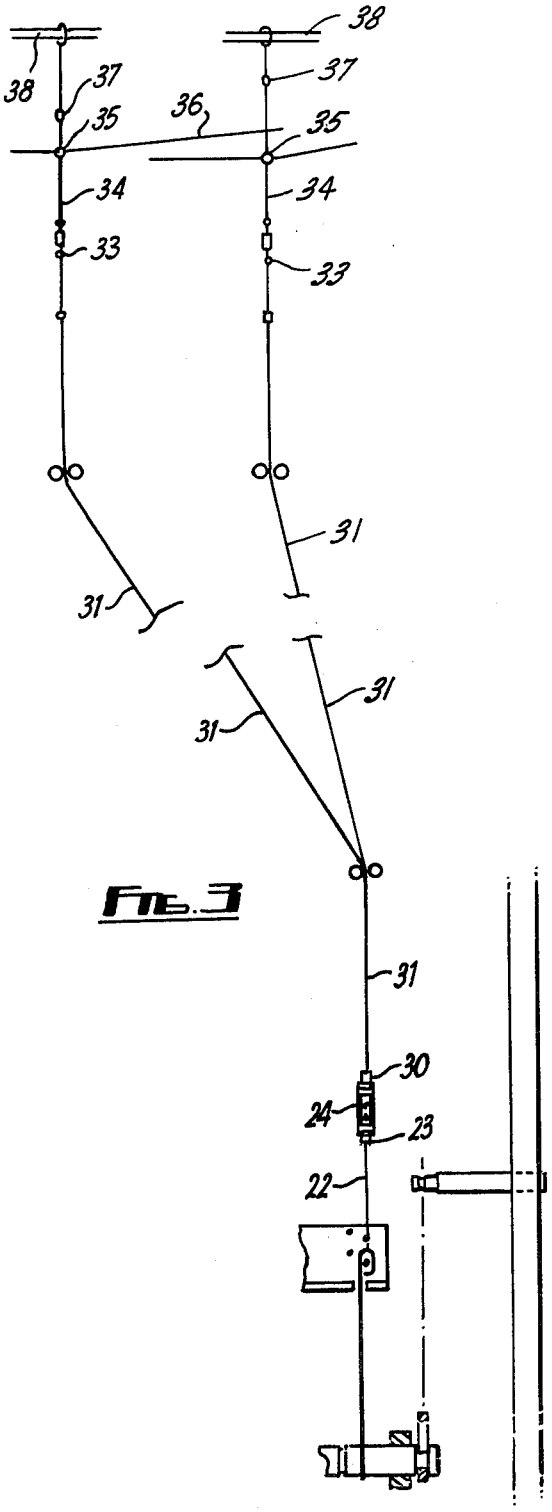
FIG. 3 is a side view showing part of the patterning means and a convenient manner in which it is connected to a yarn carrier, in this case a warp heald.

In use, in its forward position pattern strip 29 will contact tip 55 of a pattern-seeking pin 47 attached to engaging pins 27, 28, providing no pattern perforation 39 is present at that moment. This action will depress pin 47 causing either engaging pin 27 or 28 to enter engaging eye 25 or 26 depending on which of the eyes is suitably positioned. With pin 27 in engaging eye 25, as shown in FIG. 2, downward movement of lever 11 will cause lifting hook 21 to be pulled down, thus also pulling down pulley block 24 and associated heald 34. Pin 18 will freely slide upwards in lifting hook 20 without causing motion thereto.

If a pattern perforation 39 is present when pattern strip 29 is moved forward by anvil 42, then tip 55 of pattern-seeking pin 47 will pass through pattern strip 29 into recess 48 in anvil 42 without being depressed. Thus neither eye 25 or eye 26 will be engaged by pins 27, 28. Movement of levers 10, 11 will oscillate cord 22 on pulley 23 without causing any vertical motion to pulley block 24 or heald 34. Small springs 49, 50 surround pins 27, 28 to ensure the disengagement of pins 27, 28 from eyes 25, 26 when required.

Pattern-seeking pin 47 is reciprocally mounted on a lever 51 which is pivotally mounted at 52 on frame 13. An extension 53 of the lever 51 co-operates with a cam means 54 mounted on mainshaft 15 and in use receives a rocking motion such as to cause tip 55, when in contact with pattern strip 29 or engaged in a pattern perforation 39, to move with the pattern strip 29 and at the same linear rate as that of the said pattern strip.

The sequence of operation of pattern-seeking is such that anvil 42 moves forward and tip 55 of pin 47 contacts pattern strip 29 or passes through a pattern perforation 39. Pattern strip 29 and pin 47 move downwards in unison, anvil 42 moves rearwards to disengage pin 47 from pattern strip 29 which continues to move on at a constant speed, pin 47 moves upwards again for the cycle to recommence by which time the continuing movement of pattern strip 29 has brought the next pattern perforation position into line with tip 55.

It will be seen that the parts of the mechanism which are moved by contact with the pattern strip 29 are of small size and mass, and there is no interruption to the constant movement of the pattern strip. Smooth high-speed operation becomes possible. The small size of the mechanism permits it to be mounted to the loom low down below the weaving healds.

Figure 4:
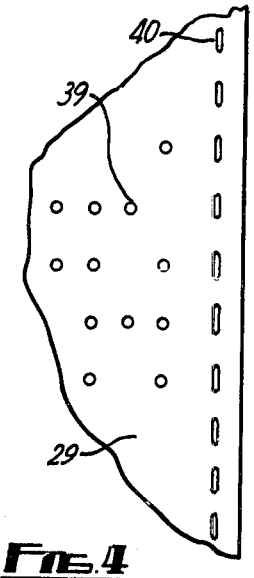
FIGS. 4, 4*a* and 4*b* are partial front views of three different pattern information carriers.
Figure 4A:
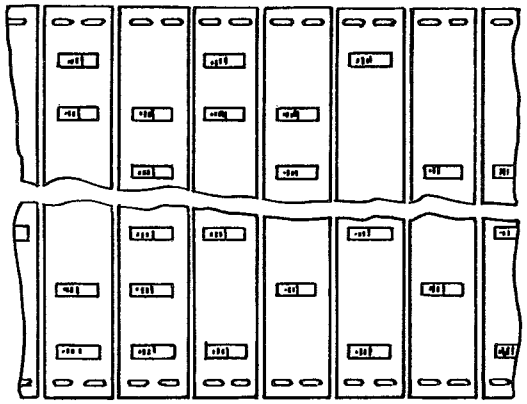
Figure 4B:
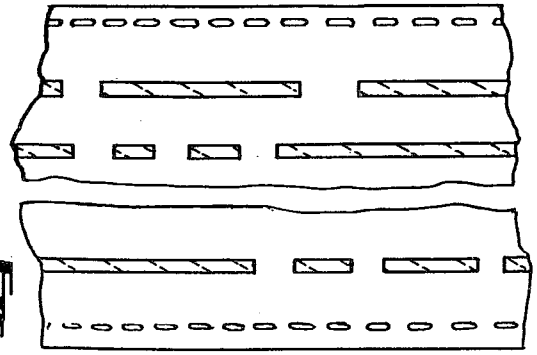

The invention is not restricted to the details given above. For example, the perforate pattern strip and engaging pin may be replaced by any pair of interengageable elements adapted when so interengaged to carry out synchronous movement for at least part of the weaving cycle. As shown in FIG. 4*a*, a pattern unit comprising a plurality of jointed elements each having pattern information means in the form of projections could be used. In this form of pattern unit engaging pins would be operative to move a heald when the pins are located between longitudinally adjacent projections. Alternative arrangement found in FIG. 4*b* a strip having light-sensitive elements thereon is provided and photocells are used to sense the presence of the elements and actuate the jacquard healds.

I claim:

1. A loom patterning mechanism including:

drive means for performing a loom function, said drive means comprising hook means attached to the ends of a first pulley mounted function control cord, said hook means each being provided with a pin engaging eye and being connected to operating lever means and a lost motion connection to an operating lever;

continuously movable pattern information means;

pivotably mounted pattern information sensing means arranged to be movable synchronously with said information means for at least part of a loom cycle;

and control means responsive to said pattern information sensing means and adapted to control said drive means in accordance with the pattern information and in timed relationship with the loom weaving cycle, said control means comprising a pair of engaging pins mounted for movement by said pattern information sensing means selectively to engage said drive means whereby, when one of said engaging pins engages one of said eyes, one end of said cord is retained, and the other end of said cord is movable by the associated operating lever to enable said pulley to be moved bodily to initiate a loom function.

2. A loom patterning mechanism as claimed in claim 1 in which the pattern information is in the form of a perforate strip adapted to be moved continuously past the pattern information sensing means to present sequentially a perforate or non-perforate region thereof to the pattern information sensing means.

3. A loom patterning mechanism as claimed in claim 1 in which the pattern information means is movable towards and away from the pattern information sensing means.

4. A loom patterning mechanism as claimed in claim 1 in which the pattern information sensing means is in the form of a pin carried upon a pivotable lever, said pin being movable by the pattern information means when, in use, contacted by a nonperforate region thereof thereby to operate a control means for a loom function.

5. A loom patterning mechanism as claimed in claim 1 in which the first pulley is carried in a pulley block in which is mounted a second pulley around which passes a loom function control cord.

6. A loom patterning mechanism as claimed in claim 5 in which the loom function control cord is anchored at one end to a fixed loom frame member and is operably associated at its other end to a movable loom part whose function is to be controlled.

7. A loom patterning mechanism as claimed in claim 6 in which the movable loom part is a heald, the function control cord being attached to one end thereof, the other end of the heald being resiliently mounted on a loom frame part.

8. A loom patterning mechanism as claimed in claim 5 in which the loom function control cord is attached by one of its ends to a fixed loom frame member and by its other end to a means connected to a plurality of healds.

9. A loom patterning mechanism as claimed in claim 1 in which cam means are provided for synchronizing the movements of the patterning mechanism.

10. A loom patterning mechanism including drive means for a loom function having hook means attached to the ends of a first function control cord and to operating lever means, said hook means each being provided with a pin engaging eye and a lost motion connection to an operating lever whereby when a pin engages an eye one end of the cord is retained, the other end of the cord being movable by the associated operating lever to enable a loom function to be initiated.

11. A loom patterning mechanism as claimed in claim 10 including a first pulley over which passes said first function control cord, a pulley block for said first pulley, a second pulley in said pulley block and a further loom function control cord passing around said second pulley operable to initiate a loom function in response to movement of an operating lever associated with said first function control cord.

12. A loom patterning mechanism as claimed in claim 11 including an anchor means for one end of said further loom function control cord, the other end of said further loom function control cord being attached to a movable loom part whose function is to be controlled.

13. A loom patterning mechanism as claimed in claim 12 in which said movable loom part is a heald, said further loom function control cord being attached to one end thereof there being a resilient means attached to the other end of said heald and a mounting for said resilient means formed on a loom frame part.

14. A loom patterning mechanism as claimed in claim 13 in which said further loom function control cord is attached by one of its ends to a fixed loom frame member and by its other end to a means connected to a plurality of healds.

15. A loom patterning mechanism as claimed in claim 13 in which said further loom function control cord is attached by one of its ends to a means for operating a weft selection mechanism of the loom the other end of said further loom function control cord being attached to a fixed loom frame member.

16. A loom patterning mechanism as claimed in claim 13 in which said further loom function control cord is attached by one of its ends to a means for operating a fabric takedown mechanism of the loom the other end of said further loom function control cord being attached to a fixed loom frame member.

17. A loom patterning mechanism as claimed in claim 10 in which cam means are provided for synchronizing the movements of the patterning mechanism.

18. A loom patterning mechanism as claimed in claim 10 including a pivotal carrier block for said eye engaging pins, resilient means being provided for each of said pins, a pattern information sensing means associated with said eye engaging pins and with movable pattern information means, said pattern information sensing means being movable synchronously with said pattern information means and adapted selectively to cause a pin to engage an eye in a hook means in accordance with the pattern information and in timed relationship with the loom weaving cycle.

19. A loom patterning mechanism as claimed in claim 18 in which the pattern information means is in the form of a perforate card adapted to be moved continuously past the pattern information sensing means to present sequentially a perforate or non-perforate region thereof to the pattern information sensing means.

20. A loom patterning mechanism as claimed in claim 18 in which the pattern information means is movable towards and away from the pattern information sensing means.

21. A loom patterning mechanism as claimed in claim 18 in which the pattern information sensing means is in the form of a pin carried upon a pivotable lever, said pin being movable by the pattern information means when, in use, contacted by a non-perforate region thereof thereby to operate a control means for a loom function.

* * * * *